United States Patent [19]

Privitera

[11] Patent Number: 4,568,210

[45] Date of Patent: Feb. 4, 1986

[54] REVERSIBLE RIBBON CARTRIDGE

[75] Inventor: David J. Privitera, Georgetown, Mass.

[73] Assignee: Wang Laboratories, Inc., Lowell, Mass.

[21] Appl. No.: 595,063

[22] Filed: Mar. 30, 1984

[51] Int. Cl.[4] ..... B41J 32/00; B41J 33/26; B41J 33/51

[52] U.S. Cl. ..... 400/235.1; 400/208

[58] Field of Search ..... 242/198; 400/208, 235, 400/235.1

[56] References Cited

U.S. PATENT DOCUMENTS

| | | | |
|---|---|---|---|
| 2,209,178 | 7/1940 | Taesler | 242/198 |
| 2,986,260 | 5/1961 | Whippo | 400/208 |
| 2,989,261 | 6/1961 | Gillette et al. | 242/198 |
| 3,349,887 | 10/1967 | Goff, Jr. | 440/235.1 |
| 4,264,223 | 4/1981 | Bemis et al. | 400/208 |

FOREIGN PATENT DOCUMENTS

| | | | |
|---|---|---|---|
| 036308 | 9/1981 | European Pat. Off. | 400/208 |
| 25490 | 3/1981 | Japan | 400/208 |
| 2091644 | 8/1982 | United Kingdom | 400/208 |

OTHER PUBLICATIONS

Garwin, "Improved Capacity Typewriter Ribbon", IBM Technical Disclosure Bulletin, vol. 22, No. 8A, p. 3469, 1/80.

*Primary Examiner*—William Pieprz

*Attorney, Agent, or Firm*—Michael H. Shanahan; Kenneth L. Milik

[57] ABSTRACT

A reversible typing ribbon cartridge has two pairs of pinch roll pairs for moving the ribbon in the direct and inverted positions respectively. When the cartridge is off the typing machine both pinch pairs are engaged with the ribbon, but as the cartridge is installed, a rod penetrates into the cartridge and disengages the pinch pair in the following position while drives engage the ribbon spool and the pinch pair in the leading position.

3 Claims, 4 Drawing Figures

REVERSIBLE RIBBON CARTRIDGE

BACKGROUND OF THE INVENTION

This invention relates to ink delivery systems for use in typing machines and the like and more particularly to reversible ribbon cartridges and mechanisms for moving an inked ribbon therein.

The market in ribbon cartridges is extremely cost competitive and it is accordingly very important to design a cartridge to minimize manufacturing costs. It is also desirable to minimize squeezing the ribbon since this tends to degrade the ribbon.

BRIEF SUMMARY OF THE INVENTION

The invention features an ink delivery system and a reversible ribbon cartridge that can be installed in a typing machine in either a direct or inverted operating position, and a ribbon drive. The ribbon cartridge has an inked ribbon running between two storage spools and passing through a printing area in position to deliver ink from one half of the ribbon when the cartridge is installed in the typing machine in a direct orientation, and is positioned at the printing area to deliver ink from the second half of the ribbon when the cartridge is installed in an inverted orientation. The cartridge includes a first pair of ribbon drive pinch rolls spanning the ribbon between the printing area and the first storage spool and a second pair of ribbon drive pinch rolls spanning the ribbon between the printing area and the second storage spool. Each of the pairs of ribbon drive pinch rolls includes a driver roll mounted for rotation on an axis fixed with respect to the cartridge and an idler roll mounted for rotation on a movable axis and urged by a spring towards the associated driver roll. Each idler roll has a disengaging surface for receiving a disengaging force for moving the idler roll against the urging of its spring away from the associated driver roll. The ribbon drive further includes a take-up driver element connected to the typing machine for engaging with the one of the spools in a leading position and to deliver a torque thereto, a take-up coupling element connected to the first spool disposed to couple with and to receive a torque from the take-up driver element when the cartridge is installed in the typing machine in the direct orientation, a take-up coupling element connected to the second spool disposed to couple with and to receive a torque from the take-up driver element when the cartridge is installed in the typing machine in the inverted orientation, a driver roll driver element connected to the typing machine for engaging with the one of the driver rolls in the leading position and to deliver a torque thereto, a driver roll coupling element connected to the driver roll of the first pair of pinch rolls disposed to couple with and to receive a torque from the driver roll driver element when the cartridge is installed in the typing machine in the direct orientation, a driver roll coupling element connected to the driver roll of the second pair of pinch rolls disposed to couple with and to receive a torque from the driver roll driver element when the cartridge is installed in the typing machine in the inverted orientation, and a displacing element affixed to the machine positioned to couple with and displace the idler roll of the second pair of ribbon drive pinch rolls when the cartridge is installed in the direct orientation and the idler roll of the first pair of ribbon drive pinch rolls when the cartridge is installed in the inverted orientation.

Detailed description.

Figure 1:
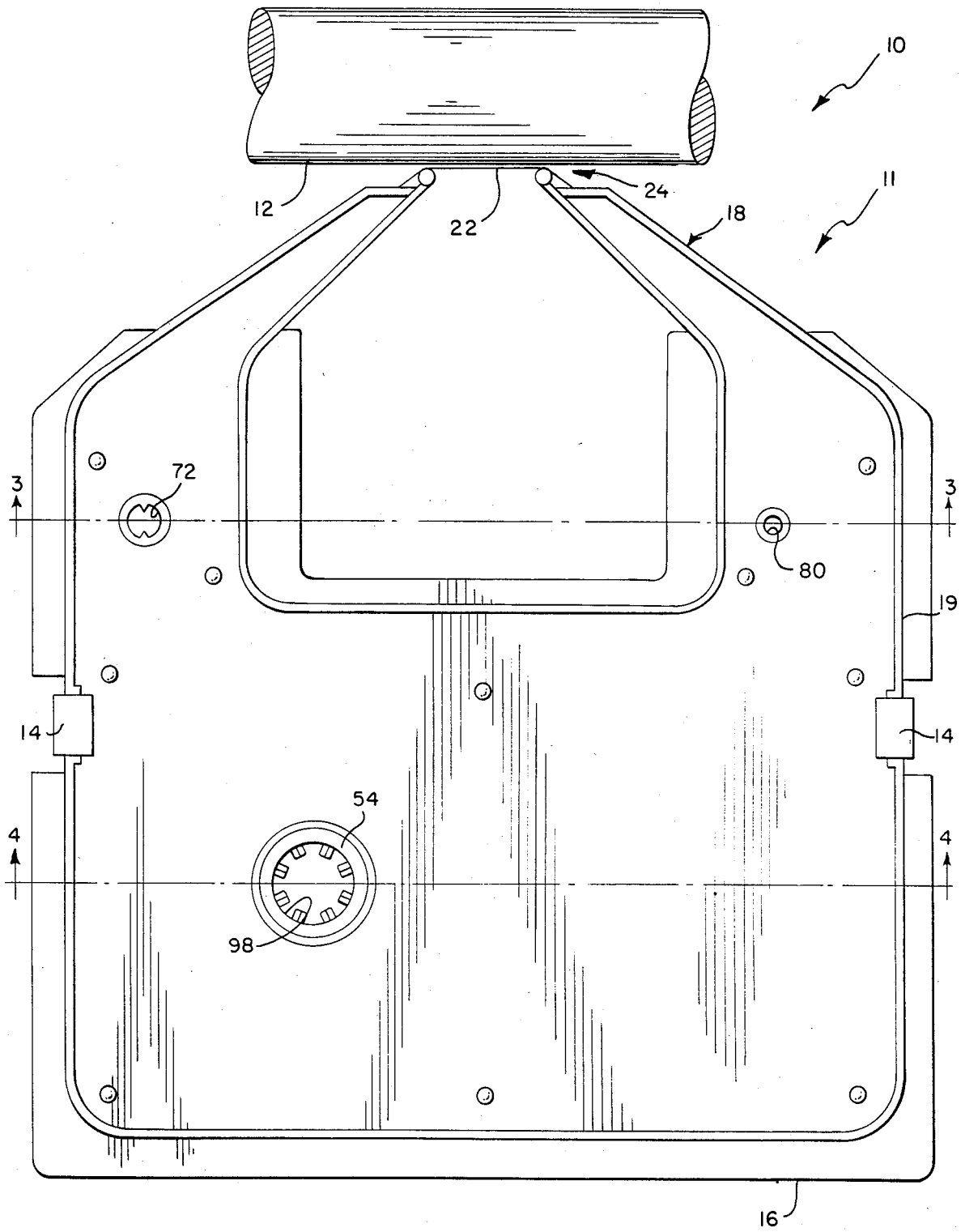
FIG. 1 shows portions of a typing machine with an ink delivery system according to the invention, including a ribbon cartridge.

Referring to the Figures, portions of typing machine 10 with the ink delivery system 11 therefor are shown. Platen roll 12 is situated before ink cartridge support platform 16. Ribbon cartridge 18 has a case 19 and is as shown in FIG. 1 supported on platform 16 and held in its operating position by spring clips 14. Cartridge 18 may be installed in typing machine 10 in a direct orientation as shown in the Figures. In the direct orientation cartridge 18 positions first half 20 of inked ribbon 22 in printing area 24 immediately in front of platen 12 for transfer of ink to paper passing over platen 12. Alternatively cartridge 18 may be rotated about its medial axis and installed in an inverted position wherein it positions second half 26 of ribbon 22 in printing area 24. Ribbon drive 25 moves ribbon 22 as typing goes forward.

Figure 2:
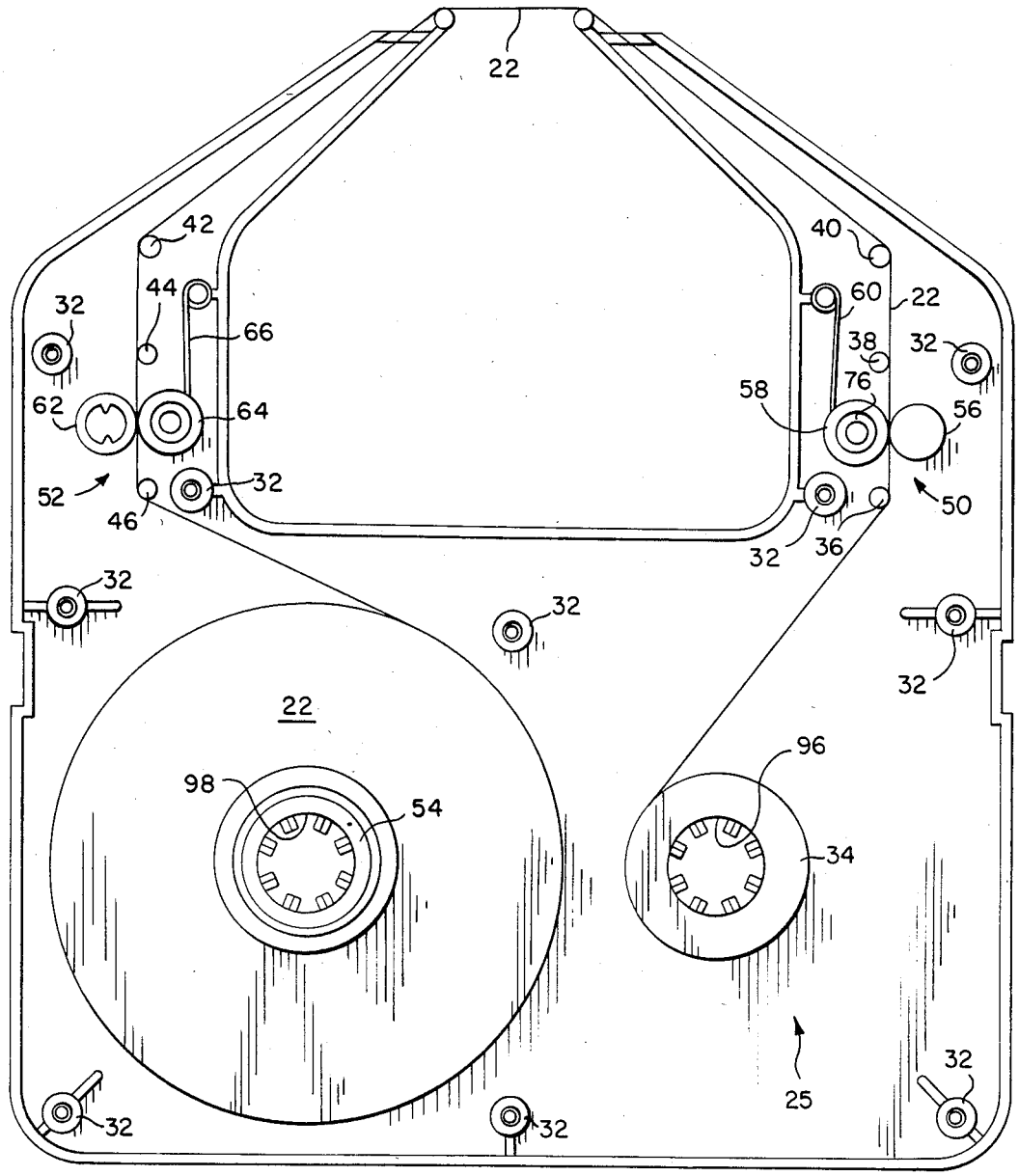
FIG. 2 shows the cartridge of FIG. 1 with the top of its case removed to reveal interior parts.

In the interior of cartridge 18, shown particularly in FIG. 2, posts 32 extend between the two sides of case 19, holding them together at the proper spacing. Ribbon 22 is affixed at one end to first ribbon storage spool 34 and then leads past guide pin 36, through first pair 50 of ribbon drive pinch rolls, past guide pins 38 and 40, through printing area 24, then past guide pins 42, and 44, through second pair 52 of ribbon drive pinch rolls, around guide pin 46 and to a second ribbon storage spool 54. First pinch roll pair 50 has a driver roll 56 mounted in journals molded in case 19 to be rotatable about an axis fixed with respect to the case and an idler roll 58 rotatably supported on a movable axis and urged into contact with driver roll 56 by spring means 60. Similarly, second pinch roll pair 52 has a driver roll 62 mounted in journals molded in case 19 to be rotatable about an axis fixed with respect to the case and an idler roll 64 rotatably supported on a movable axis and urged into contact with driver roll 62 by spring means 66. Driver roll 56 has a splined cavity 70 providing a coupling element for receiving torque, and driver roll 62 has similar splined cavity 72. Idler roll 58 has an interior disengaging surface 76 of generally cylindrical form opening away from the medial plane of roll 58 for receiving a disengaging force to push idler roll 58 away from driver roll 56. Similarly, idler roll 64 has an interior disengaging surface 78 for receiving a disengaging force to push idler roll 64 away from driver roll 62. Rod-like displacing element 84 is supported on platform 16. Openings 80 and 82 in case 19 provide means for admitting displacing element 84 to couple with disengaging surfaces 76 or 78. Driver roll driver element 86 is supported on platform 16 and has a splined surface 88 for engaging the driver roll coupling element 70 or 72. Driver roll driver element 86 is terminated in gear 90 situated below platform 16 which in turn is engaged by drive belt 92. First spool 34 has splined interior surface 96 providing a first take-up coupling element for receiving a torque, and second spool 54 has splined interior surface 98 providing a second take-up coupling element for receiving a torque. Take-up driver element 100 is supported on platform 16 and has splined surface 102 for engaging with and providing a torque to take-up coupling element 96 or 98. Take-up driver element 100 is connected through a slip clutch (not shown) to gear 104 situated below platform 16 which in turn is engaged with drive belt 92. Drive belt 92 is driven by a motor (not shown) in accordance with the progress of the operation of the typing machine in a manner well known in the typing machine art.

Figure 3:
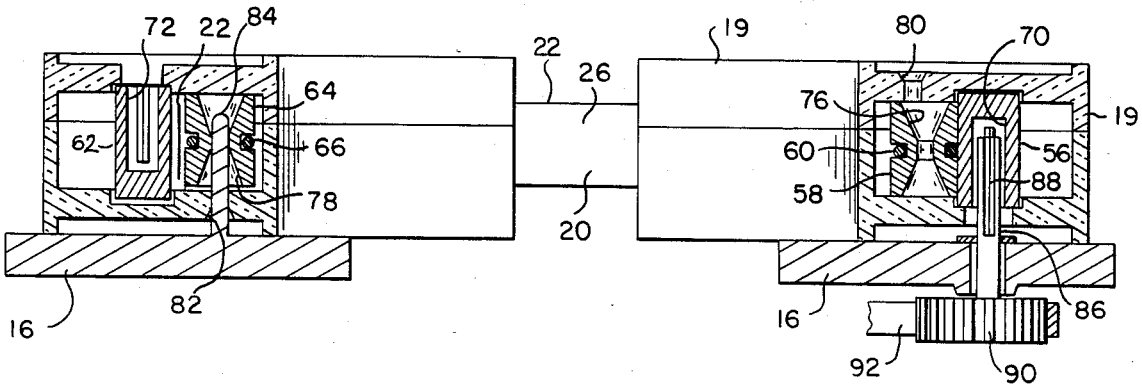
FIG. 3 shows a sectional view of the system of FIG. 1 along the line 3—3.
Figure 4:
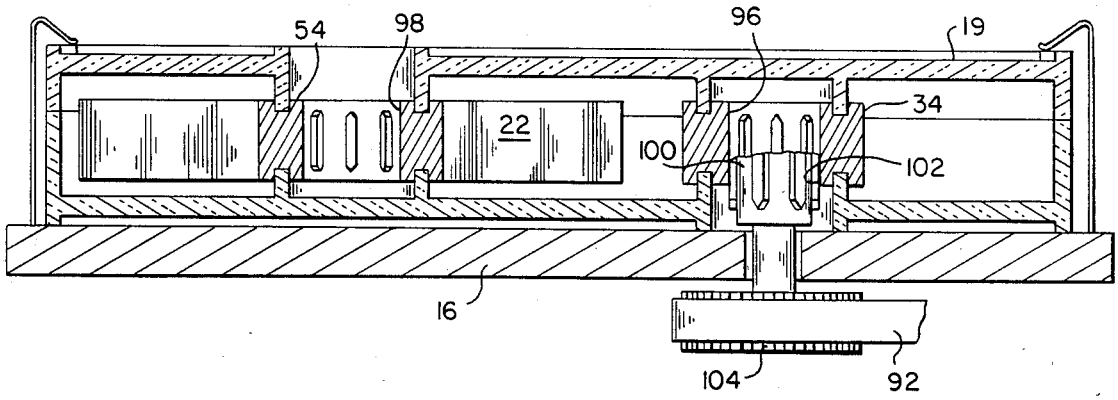
FIG. 4 shows a sectional view of the system of FIG. 1 along the line 4—4.

The operation of the system is as follows. Prior to first use the ribbon of the ribbon cartridge is entirely stored on second spool 54 as illustrated in FIG. 2. Both pinch roll pairs 50 and 52 are closed by the urging of their associated springs 60 and 66 and pinch the ribbon. Initial installation of the cartridge in the printing machine is accomplished by pressing the cartridge downwards onto platform 16, the positioning being guided by holding clips 14, which finally snap to lock the cartridge in place. As the cartridge is pressed downwards, displacing element 84 enters opening 82 in case 16 and engages sloped surface 78 of idler roll 64, providing a force moving idler roll 64 away from driver roll 62 and releasing the pinch on the ribbon. Also as the cartridge is pressed onto the platform, driver roll driver element 86 penetrates into driver roll 56 and engages it, while take-up driver element 100 penetrates into spool 34 and engages it. The cartridge is now in the direct orientation with spool 34 and pinch roll pair 50 in the leading positions, with spool 54 and pinch roll 52 in the following positions, and with the positions of the various parts as illustrated in FIGS. 3 and 4. In particular leading pinch roll pair 50 is closed and following pinch roll pair 52 is open. Additionally, first half 20 of the ribbon is positioned in the printing position in front of the platen. Typing then proceeds with belt 92 being driven in step with the typing. The movement of the belt rotates driver roll driver element 86 which in turn turns driver roll 56, while take-up driver element 100, also driven by the belt through the slip clutch maintains a torque on spool 34. The ribbon is thus pulled off spool 54 and across the printing area by pinch pair 50 and wound onto spool 34. The ribbon moves without any drag from following pinch roll pair 52 since pair 52 is now forced open. When the ribbon has been transferred to spool 58 in the course of typing, the cartridge is removed from the platform and turned over and installed in the inverted orientation. The same events are repeated except that now spool 54 and pinch roll pair 52 are in the leading positions with spool 34 and pinch roll pair 50 in the following position and the second half of the ribbon is presented to the print area. The following pinch roll pair is as before opened by displacing element 84 and the ribbon is pulled by the leading pinch roll pair without drag from the following pinch roll pair.

The inking system and cartridge described provides a conveniently reversible ribbon which can be used sequentially on its two haves. The cartridge can be manufactured at very low cost because of the design requires only a small number of simple parts and the assembly is easy. At the same time the operation of the system and cartridge avoids any drag or unnecessary squeezing of the ribbon by the following pinch roll pair.

Variations from the described embodiment within the spirit of the invention and the claims will be readily apparent to those skilled in the printing machine art.

What is claimed is:

1. In an ink delivery system for use in a typing machine, said system including a ribbon cartridge, means attached to said typing machine for holding a ribbon cartridge in an operating position, and a ribbon drive, said ribbon cartridge having an inked ribbon running between two storage spools and passing through a printing area in position to deliver ink from one half of the ribbon when the cartridge is installed in the typing machine in a direct orientation wherein the first of said spools assumes a leading position, the second of said spools assumes a trailing position, and the ribbon is moved from the second storage spool to the first storage spool, and is positioned at the printing area to deliver ink from the second half of the ribbon when the cartridge is installed in an inverted orientation wherein the second of said spools assumes a leading position, the first of said spools assumes a trailing position, and the ribbon is moved from the first storage spool to the second storage spool, said cartridge including a first pair of ribbon drive pinch rolls spanning the ribbon between the printing area and the first storage spool and a second pair of ribbon drive pinch rolls spanning the ribbon between the printing area and the second storage spool, an improvement wherein each of said pairs of ribbon drive pinch rolls includes a driver roll mounted for rotation on an axis fixed with respect to the cartridge and an idler roll mounted for rotation on a movable axis and urged by a spring means towards the associated driver roll, each idler roll having a sloped interior bore acting as a disengaging surface for receiving a disengaging force for moving said idler roll against the urging of said spring means away from the associated driver roll said ribbon drive further including a take-up driver element connected to the typing machine for engaging with the one of said spools in a leading position and to deliver a torque thereto, a take-up coupling element connected to said first spool disposed to couple with and to receive a torque from the take-up driver element when the cartridge is installed in the typing machine in the direct orientation, a take-up coupling element connected to said second spool disposed to couple with and to receive a torque from the take-up driver element when the cartridge is installed in the typing machine in the inverted orientation, a driver roll driver element connected to the typing machine for engaging with the one of said driver rolls in the leading position and to deliver a torque thereto, a driver roll coupling element connected to the driver roll of the first pair of pinch rolls disposed to couple with and to receive a torque from the driver roll driver element when the cartridge is installed in the typing machine in the direct orientation, a driver roll coupling element connected to the driver roll of the second pair of pinch rolls disposed to couple with and to receive a torque from the driver roll driver element when the cartridge is installed in the typing machine in the inverted orientation, a displacing element affixed to said machine positioned to couple with said sloped interior bore of the trailing idler roll and displace away from its associated driver roll the idler roll of the one of said ribbon drive pinch roll pairs between the printing area and the one of said storage spools installed in the trailing position.

2. A reversible ribbon cartridge for installation in a typing machine or the like, said cartridge including an inked ribbon running between two storage spools and passing through a printing area in position to deliver ink from one half of the ribbon when the cartridge is installed in a typing machine in a direct orientation wherein the first of said spools assumes a leading position, the second of said spools assumes a trailing position, and the ribbon is moved from the second storage spool to the first storage spool, and is positioned at the printing area to deliver ink from the second half of the ribbon when the cartridge is installed in an inverted orientation wherein the second of said spools assumes a leading position, the first of said spools assumes the trailing position, and the ribbon is moved from the first storage spool to the second storage spool, a take-up coupling element connected to said first spool disposed to couple with and to receive a torque from a take-up driver element of a typing machine when the cartridge is installed in the typing machine in the direct orientation, a take-up coupling element connected to said second spool disposed to couple with and to receive a torque from the same take-up driver element when the cartridge is installed in the typing machine in the inverted orientation, said cartridge including a first pair of ribbon drive pinch rolls spanning the ribbon between the printing area and the first storage spool and a second pair of ribbon drive pinch rolls spanning the ribbon between the printing area and the second storage spool, each of said pairs of ribbon drive pinch rolls including a driver roll mounted for rotation on an axis fixed with respect to the cartridge and an idler roll mounted for rotation on a movable axis and urged by a spring means towards the associated driver roll, each idler roll having a sloped interior bore acting as a disengaging surface for receiving only when said idler roll is installed in the position between the printing area and the spool in the trailing position a disengaging force applied by a disengaging element of a typing machine for moving said idler roll against the urging of its said spring means away from the associated driver roll, the disengaging surface of the idler roll of the first pair of ribbon drive pinch rolls occupying when the cartridge is installed in the inverse position the same location occupied by the disengaging surface of the idler roll of the second pair of ribbon drive pinch rolls when the cartridge is installed in the direct position.

3. A cartridge as claimed in claim 2, said cartridge having a case enclosing said spools and pairs of pinch rolls, said case having second admitting means for admitting a displacing element affixed to said machine to couple with and displace the idler roll of the second pair of ribbon drive pinch rolls when the cartridge is installed in the direct orientation and first admitting means for admitting the same displacing element to couple with and displace the idler roll of the first pair of ribbon drive pinch rolls when the cartridge is installed in the inverted orientation.

* * * * *